US005472765A

United States Patent [19]

Green

[11] Patent Number: 5,472,765

[45] Date of Patent: Dec. 5, 1995

[54] SHED ANTLER MOUNTING KIT

[76] Inventor: Larry E. Green, 604 N. Sixth St., Youngwood, Pa. 15697

[21] Appl. No.: 273,193

[22] Filed: Jul. 11, 1994

[51] Int. Cl.[6] ..... B44C 5/02

[52] U.S. Cl. ..... 428/99; 428/16; 428/542.4; 428/913.3; 434/296

[58] Field of Search ..... 428/99, 16, 542.4, 428/913.3; 434/296

[56] References Cited

U.S. PATENT DOCUMENTS 3,301,728 1/1967 Swartz ..... 428/913.3

4,464,440 8/1984 Dotzman ..... 428/542.4

*Primary Examiner*—Alexander S. Thomas

[57] ABSTRACT

A shed antler mounting kit including a model skull replica having provision for attachment of shed antlers, a wedgelike mounting interface, and a plaque with an engraved placard attached thereto. The skull replica is devised to mimic an animal skull of the same character as the originator of the shed antlers.

1 Claim, 3 Drawing Sheets

SHED ANTLER MOUNTING KIT

BACKGROUND OF THE INVENTION

1. Field of the Invention

The present invention relates to taxidermy and the mounting of animal antlers and more particularly pertains to a shed antler mounting kit which may be employed to mount antlers shed by deer and other animals in an aesthetically pleasing manner.

2. Description of the Prior Art

The use of wall mounting kits is known in the prior art. More specifically, wall mounting kits heretofore devised and utilized for mounting antlers of various animals are known to consist basically of familiar, expected and obvious structural configurations, notwithstanding the myriad of designs encompassed by the crowded prior art which have been developed for the fulfillment of countless objectives and requirements.

The present invention is directed to improving devices for a shed antler mounting kit in a manner which is safe, secure, economical and aesthetically pleasing.

For example, U.S. Pat. No. 4,971,865 to Nowlan discloses an adjustable antler hanger bracket comprising an L-shaped bracket devised for mounting an adult male deer's skull with antlers attached. There is no provision in the Nowlan invention for mounting shed antlers or antlers without a skull member. The present invention is devised to enable mounting of antlers without a skull and is furthermore directed toward improving the display of collected shed antlers.

In U.S. Pat. No. 4,464,440 to Dotzman a trophy mount is disclosed. The Dotzman invention is applicable to mounting of antlers wherein the antlers have been removed from an animal in a substantially precise fashion. The present invention does not involve the removal of antlers from an animal and is directed toward improving the display of antlers shed by animals during natural life cycles.

In U.S. Pat. No. Des. 269,448 to Fisher et al. the ornamental design of a model skull is described comprising a substantially humanoid skull character having simplified mandibular and cranial portions and a substantially accurate dentition. There is no provision for mounting animal antlers for display in the Fisher et al. invention. The present invention comprises a mounting for shed antlers and includes a model animal skull but is devoid of an human model skull.

In U.S. Pat. No. 4,775,323 to Johnson a horned animal head mannikin is disclosed having a recessed flat skull surface between upstanding front and rear walls with a domed ridge disposed therein. A disadvantage in this prior art lies in a lack of provision for fastening shed antlers upon the animal mannikin for the purpose of displaying the antlers as a wall hanging. The present invention is devised for displaying shed antlers upon an artificial animal skull as a wall hanging.

U.S. Pat. No. 4,323,630 to Mackey et al. discloses a trophy support column. The disclosure teaches a support column for a trophy comprising two parts. The disclosure makes no provision for simulating an antler bearing animal skull. Furthermore, there are no provisions for affixing shed antlers thereupon. The present invention comprises a wall hanging mounting for shed antlers with a model animal skull to which the shed antlers are affixed.

In this respect, the shed antler mounting kit according to the present invention substantially departs from the conventional concepts and designs of the prior art, and in so doing provides an apparatus primarily developed for the purpose of displaying collected shed antlers as affixed to a simulated animal skull.

Therefore, it can be appreciated that there exists a continuing need for new and improved antler mounting kits which can be employed to display shed antler collections. In this regard, the present invention substantially fulfills this need.

As illustrated by the background art, efforts are continuously being made in an attempt to improve mounted antler displays. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of antler mounting kits and displays now present in the prior art, the present invention provides an improved shed antler mounting kit construction wherein the same can be utilized for mounting and displaying shed antlers fastened to a simulated animal skull. As such, the general purpose of the present invention, which will be described subsequently in greater detail, is to provide a new and improved shed antler mounting kit apparatus and method which has all the advantages of the prior art antler mountings and none of the disadvantages.

The invention is defined by the appended claims with the specific embodiment shown in the attached drawings. For the purpose of summarizing the invention, the invention may be incorporated into a simulated animal skull of relevance, a plaque base, and a set of shed antlers wherein the shed antlers are affixed to the simulated skull to produce a more natural appearance. The antlers and skull are fastened to the plaque base which may be affixed to an existing wall.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved shed antler mounting kit having a simulated animal skull and a base plaque for attachment of shed antlers thereupon for display.

It is therefore an additional object of the present invention to provide a new and improved shed antler mounting kit which has all the advantages of the prior art shed antler mounting kits and none of the disadvantages.

It is another object of the present invention to provide a new and improved shed antler mounting kit which may be easily and efficiently manufactured and marketed.

It is a further object of the present invention to provide a new and improved shed antler mounting kit which is of a durable and reliable construction.

An even further object of the present invention is to provide a new and improved shed antler mounting kit which is susceptible of a low cost of manufacture with regard to both materials and labor, and which accordingly is then susceptible of low prices of sale to the consuming public, thereby making such shed antler mounting kits economically available to the buying public.

Still yet another object of the present invention is to provide a new and improved shed antler mounting kit which provides in the apparatuses and methods of the prior art some of the advantages thereof, while simultaneously overcoming some of the disadvantages normally associated therewith.

Still another object of the present invention is to provide a new and improved shed antler mounting kit having a representative model animal skull devised for attachment of particular shed antlers.

Yet another object of the present invention is to provide a new and improved shed antler mounting kit having a wall mounting base and dovetail engagement members for displaying the shed antlers.

Even still another object of the present invention is to provide a new and improved shed antler mounting kit having a dowel pin shed antler fastening means for joining the antlers to a simulated animal skull.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
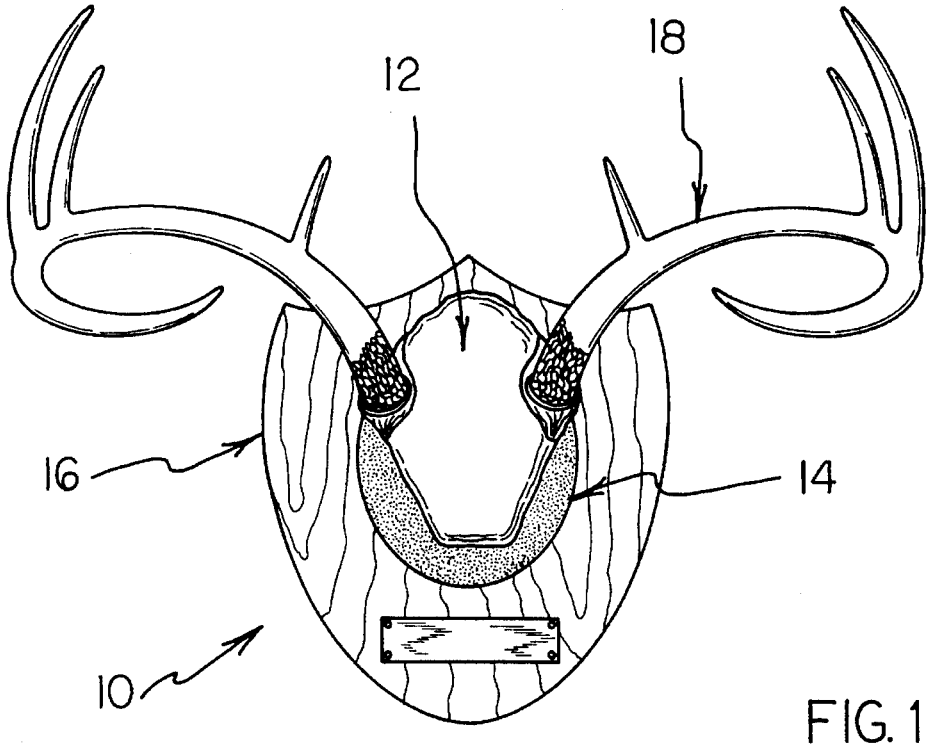
FIG. 1 is a side elevational view of the shed antler mounting kit showing the disposition of various visible components thereof.

With reference now to the drawings, and in particular to FIG. 1 thereof, a new and improved shed antler mounting kit embodying the principles and concepts of the present invention and generally designated by the reference numeral 10 will be described.

From an overview standpoint, the shed antler mounting kit 10 is adapted for use with a wall and wall hanger disposed thereon. See FIG. 1. The shed antler mounting kit 10 comprises an animal skull replica 12, a mounting wedge 14, a plaquelike base 16, and a shed antler set 18. The shed antler mounting kit 10 is devised to provide an aesthetically pleasing wall mount for shed antlers 18 wherein an animal skull replica 12 imparts a degree of realism and ornament.

Figure 2:
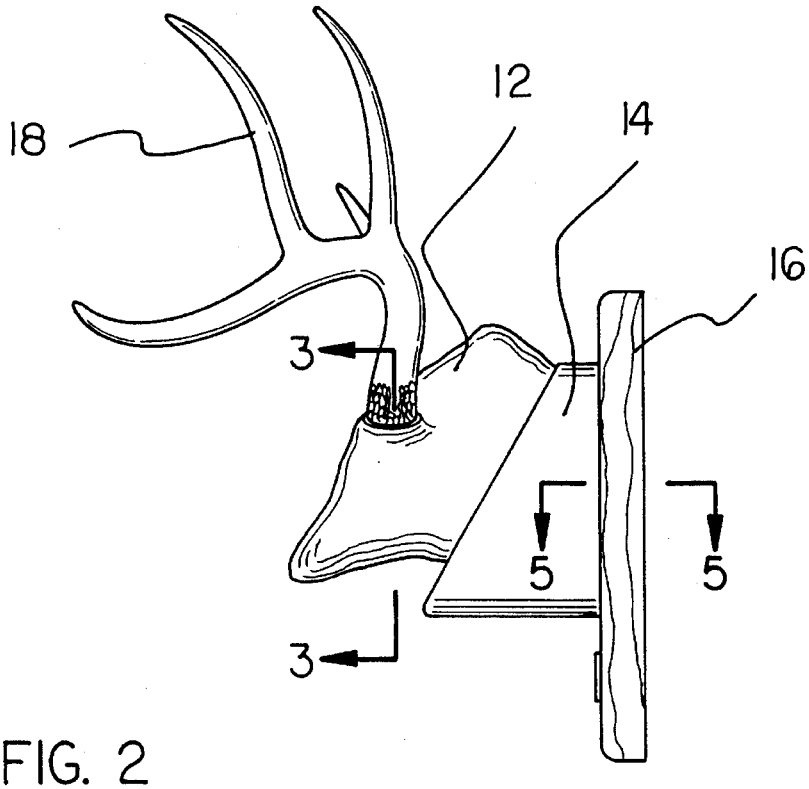
FIG. 2 is a side elevational view of the shed antler mounting kit in a hanging display position.
Figure 4:
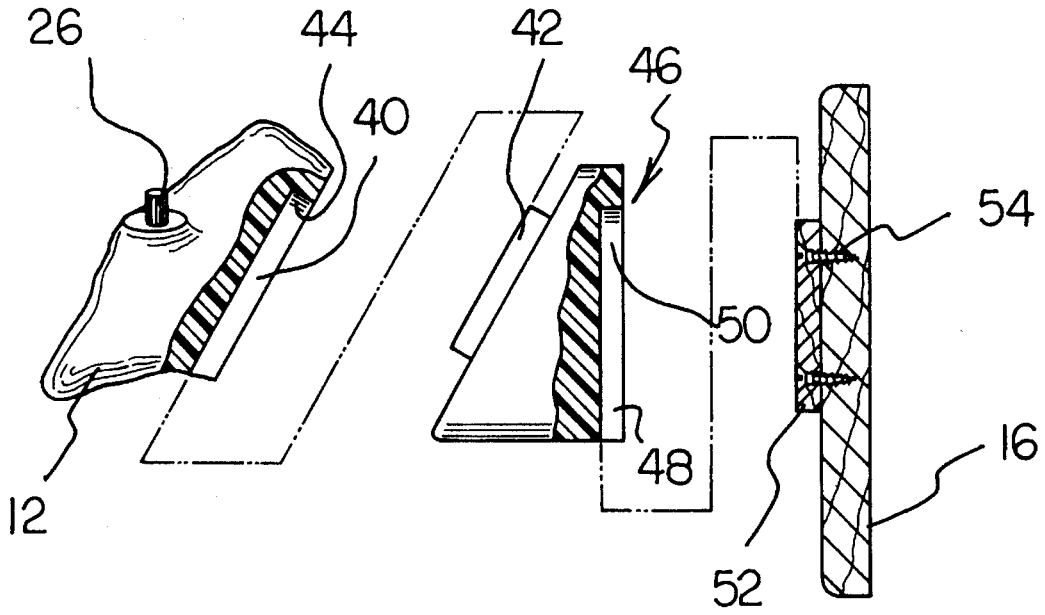
FIG. 4 is an exploded partial cutaway view of the shed antler mounting kit showing the series of engaging components required to fabricate a finished kit less shed antlers.

More specifically, it will be noted that the shed antler mounting kit 10 comprises an animal skull replica 12 presenting several features of an animal skull representative of a specific animal class whose shed antlers 18 are to be displayed, a mounting wedge 14 interfacing the skull replica 12 to a substantially planar plaquelike base 16, and a shed antler set 18 collected for display purposes. See FIG. 2. Animal skull replica 18 comprises a polymeric or cementitious reproduction of a skull of an animal such as a deer, and more specifically a particular skull type say of white tail deer may be offered in a range of sizes corresponding to average skull sizes established by grouping the various sizes of shed antlers found in field collecting into a few judiciously selected size ranges.

Figure 3:
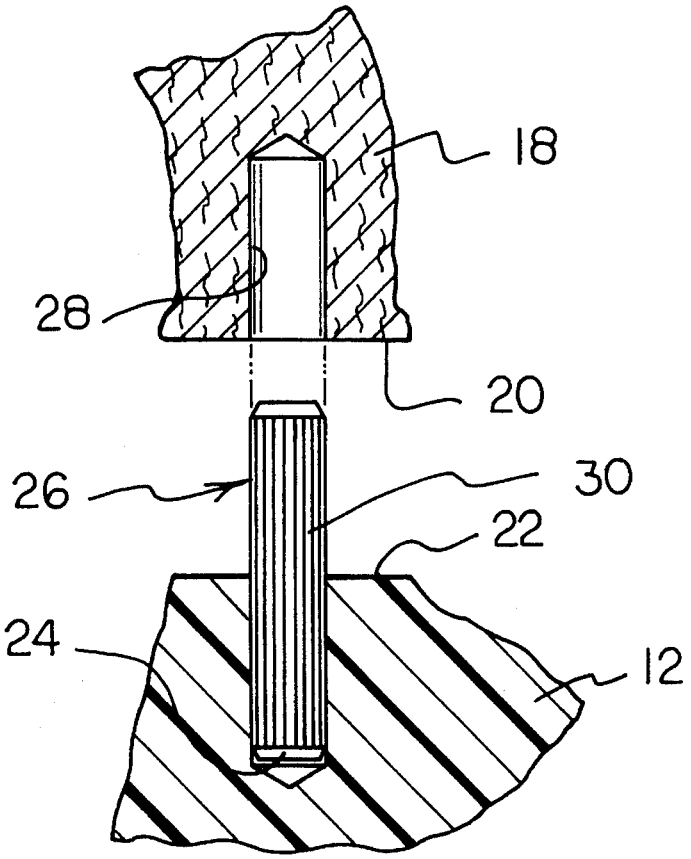
FIG. 3 is a fragmentary exploded side sectional view of a shed antler mounting kit taken substantially upon the plane indicated by the section line 3—3 of FIG. 2.

A method of preparing a suitable skull replica 12 involves fabrication of a skull mold by covering a portion of an existing bone skull with latex rubber or an alternate mold making material. Curing and removal of the covering results in a mold from which a plurality of skull replicas may be made by a casting process. The skull so replicated may comprise plaster, ceramic, polymeric, or other cementitious material susceptible to durable employ in wall mounting. Skull replica 12 may be treated with a surface covering such as paint or sealer, and decorative effects such as adhesive fastening of shells, stones, and beads is also feasible. Skull replica 12 engages a flattened antler base portion 20 of shed antlers 18 wherein a substantially flattened engagement surface 22 is disposed upon skull replica 12 thereby presenting shed antlers 18 in a symmetric natural orientation. See FIG. 3.

Skull replica 12 has a hole 24 bored part way therethrough wherein hole 24 is substantially aligned with a normal to engagement surface 22. Dowel pin 26 is partially inserted and adhesively bonded within hole 24. Shed antler 18 has a hole 28 disposed therein. Hole 28 is substantially of equivalent diameter to hole 24 and shed antler 18 is caused to forcibly engage a protruding portion 30 of dowel pin 26 and, with the application of adhesive thereto is caused to permanently bong shed antler 18 to skull replica 12.

Skull replica 12 is affixed to mounting wedge 14 using a dovetail slot 40 disposed upon skull replica 12 and a complementary dovetail tongue 42 disposed upon mounting wedge 14. In operation dovetail tongue 42 slidably engages dovetail slot 40 to a slot terminus 44 wherein the slot terminus precludes further engagement thereof. The dovetail tongue 42 and dovetail slot may be adhesively enfastened or employed without adhesion to permit removal of skull replica 12 and shed antlers 18 for cleaning or replacement with a second set thereof.

Figure 5:
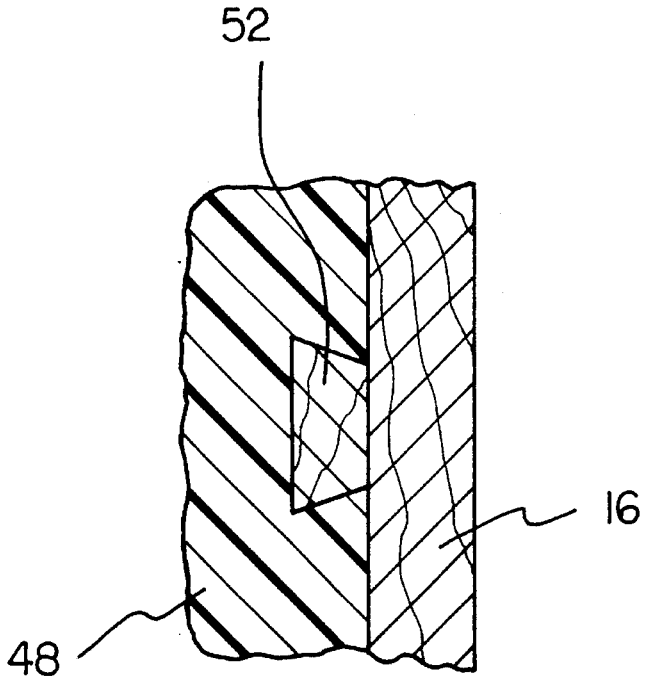
FIG. 5 is a fragmentary side sectional view of a shed antler mounting kit taken substantially upon the plane indicated by the section line 5—5 of FIG. 2.
Figure 6:
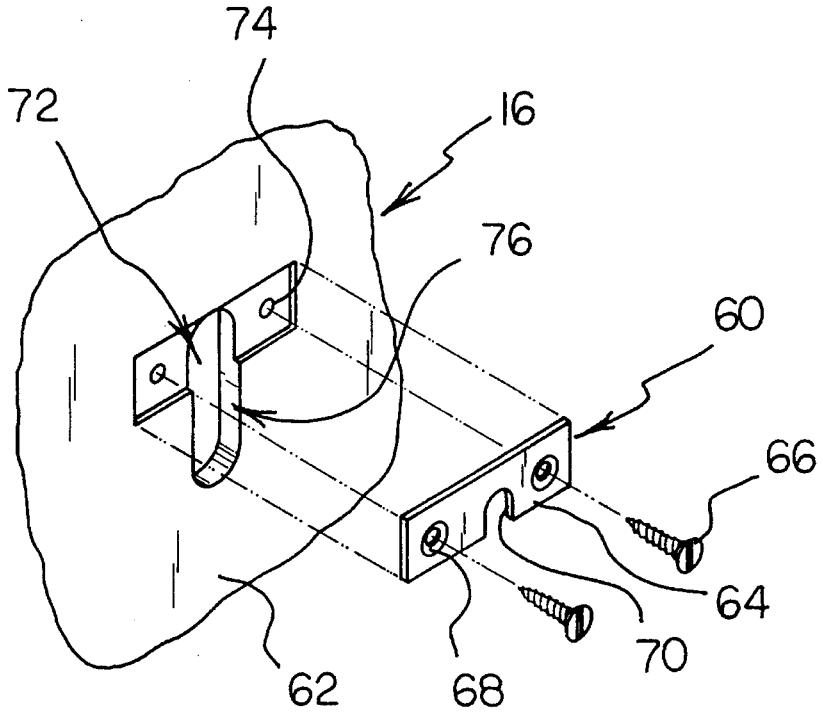
FIG. 6 is an exploded fragmentary perspective view of the shed antler mounting kit showing a wall mounting hardware assembly.

Mounting wedge 14 comprises a substantially wooden or polymeric solid or semi-solid which may have a painted or varnished finish, or may have a covering such as colored felt applied thereto for added aesthetic value. Mounting wedge 14 may comprise a right circular cylinder having a first face substantially orthogonally disposed with respect to an axis thereof and a second face disposed at an angle to the axis thereof wherein the first face 46 engages plaquelike base 16 and the second face 48 engages skull replica 12. Second face 48 has dovetail tongue 42 disposed thereupon and is otherwise substantially flat. First face 46 has a dovetail slot 48 and a slot terminus 50 disposed therein. Plaquelike base 16 has dovetail tongue 52 affixed thereto using threaded fasteners 54. Adhesives may also be employed to affix dovetail tongue 52 to plaquelike base 16 or dovetail tongue may be formed as a portion of plaquelike base 16 as is feasible in injection molding of plastics. In operation dovetail slot 48 and dovetail tongue 52 engage thereby affixing mounting wedge 14 to plaquelike base 16. See FIG. 5.

The shed antler mounting kit 10 is removably affixed to an existing wall using an hooklike wall fastener and a hanger assembly 60 wherein the hanger assembly is affixed to the plaquelike base 16 on wall engagement side 62 thereof. The hanger assembly 60 comprises a support bar 64 affixed to plaquelike base 16 by threaded fasteners 66. Support bar 66 comprises a rigid barlike member having through holes 68 disposed therein and a centrally disposed notch 70. Hollowed portion 72 of plaquelike base 16 comprises a first hollowed portion 74 engaging the support bar 64 and a second hollowed portion 76 permitting free entry of an existing wall hanger hooking portion.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A new and improved shed antler mounting kit for mounting shed antlers comprising:

a replicated animal skull, said replicated animal skull has disposed thereupon first and second shed antler mounting bases wherein the first antler mounting base comprises a first flattened region having a centrally disposed first hole bored partially therethrough and furthermore said first hole has an axis substantially normally disposed to a surface defined by said first flattened region;

the second shed antler mounting base comprises a second flattened region having a centrally disposed second hole bored partially therethrough and furthermore said second hole has an axis substantially normally disposed to a surface defined by said second flattened region;

the first and second flattened regions having a centrally disposed first and second hole, and of consequence, the axis of said first hole and said second hole are symmetrically disposed in angular relationship and physical location about a plane passing through the skull replica and separating said skull replica into a right half and a left half;

a plaquelike base member, said plaquelike base member comprising a plate having a contoured periphery thereof and having a dovetail tongue disposed substantially centrally thereupon wherein said dovetail tongue is aligned in a substantially vertical direction whenever said base member is hung for display; and an interface member joining the replicated animal skull and the plaquelike base member, said interface member comprising a substantially cylindrical wedge shaped solid with a profile of a right triangle wherein a first flattened surface thereof has a first dovetail slot disposed therein for engaging a dovetail tongue disposed upon a skull replica and a second flattened surface thereof has a second dovetail slot disposed thereon wherein said second dovetail slot engages a dovetail tongue disposed upon said plaquelike base member.

* * * * *